US006938570B2

(12) United States Patent
Montgomery et al.

(10) Patent No.: US 6,938,570 B2
(45) Date of Patent: Sep. 6, 2005

(54) MOORING ROBOT

(75) Inventors: Peter James Montgomery, Christchurch (NZ); Bryan John Rossiter, Christchurch (NZ)

(73) Assignee: Mooring Systems Limited, Christchurch (NZ)

( * ) Notice: Subject to any disclaimer, the term of this patent is extended or adjusted under 35 U.S.C. 154(b) by 0 days.

(21) Appl. No.: 10/475,023

(22) PCT Filed: Apr. 17, 2002

(86) PCT No.: PCT/NZ02/00062

§ 371 (c)(1),
(2), (4) Date: May 10, 2004

(87) PCT Pub. No.: WO02/090176

PCT Pub. Date: Nov. 14, 2002

(65) Prior Publication Data

US 2004/0182296 A1 Sep. 23, 2004

(30) Foreign Application Priority Data

Apr. 17, 2001 (NZ) ..... 511129

(51) Int. Cl.[7] ..... B63B 21/00

(52) U.S. Cl. ..... 114/230.1; 114/230.16; 114/249; 114/250

(58) Field of Search ..... 114/230.1, 230.15, 114/230.16, 230.17, 230.22, 249, 250

(56) References Cited

U.S. PATENT DOCUMENTS

| | | | | |
|---|---|---|---|---|
| 3,227,481 | A | 1/1966 | Creskoff | |
| 3,322,091 | A | 5/1967 | Stanwick | |
| 3,463,114 | A | 8/1969 | Lovell | |
| 3,974,794 | A | 8/1976 | Kakitani et al. | |
| 4,055,137 | A | 10/1977 | Motai et al. | |
| 4,532,879 | A | 8/1985 | Ortloff | |
| 4,543,070 | A | 9/1985 | Olsen et al. | |
| 4,549,835 | A * | 10/1985 | Ando et al. | 405/4 |
| 4,852,926 | A | 8/1989 | Littell | |
| 5,676,085 | A | 10/1997 | Michl, Jr. | |
| 6,439,147 | B2 | 8/2002 | Cottrell et al. | |
| 2001/0029879 | A1 | 10/2001 | Cottrell et al. | |
| 2004/0154518 | A1 * | 8/2004 | Hadcroft et al. | 114/230.1 |

FOREIGN PATENT DOCUMENTS

| | | |
|---|---|---|
| DE | 25 57 964 | 12/1976 |
| DE | 92 07 648.3 | 10/1992 |
| FR | 2 672 650 | 8/1992 |
| GB | 1 491 511 | 11/1977 |
| JP | 55-44057 | 3/1980 |
| JP | 58-206478 | 12/1983 |
| JP | 61-218495 | 9/1986 |
| JP | 7-33075 | 2/1995 |
| JP | 8-34388 | 2/1996 |
| NL | 8600973 | 11/1987 |
| WO | WO 91/14615 | 10/1991 |
| WO | WO 98/17868 | 4/1998 |
| WO | WO 01/62585 | 8/2001 |

* cited by examiner

*Primary Examiner*—Sherman Basinger
(74) *Attorney, Agent, or Firm*—Knobbe, Martens, Olson & Bear LLP

(57) ABSTRACT

A mooring robot which can be dock-mounted, and can also include vacuum cups for engagement with the freeboard of a ship. The robot can position the vacuum cups within a three-dimensional operating envelope. A parallel arm linkage having two parallel arms pivoted about respective axes which are parallel to the longitudinal axis of the ship are fixed to the dock for extending and retracting the vacuum cups in the transverse direction. The parallel arms are fixed to a vertical elongate guide to which the vacuum cups are slidably fixed, the parallel arms raising and lowering the vacuum cups and maintaining the guide substantially vertical. The vacuum cups are mounted for sliding in substantially horizontal track aligned parallel with the longitudinal axis of the ship for fore and aft movement of the vacuum cups. A mooring system can also include a plurality of the mooring robots being remotely controlled.

13 Claims, 4 Drawing Sheets

MOORING ROBOT

RELATED APPLICATIONS

This application is a national phase entry in the United States of the International Application PCT/NZ02/00062 filed Apr. 17, 2002, and claims the benefit of New Zealand Application 511129 filed Apr. 17, 2001.

TECHNICAL FIELD

The present invention generally to mooring and more particularly, to robotic mooring devices for mooring large vessels.

BACKGROUND ART

When mooring a container ship or similar large vessel to a dock, in order to inhibit damage to the ship or the dock, a mooring robot is generally provided that is adequately strong to resist the forces exerted on it by the action of the wind, waves, passing vessels and tide. The mooring robot also accommodates relative vertical movement between the dock and the ship due to variations in tides and displacement. Further, the mooring robot should permit the connection between the ship and the dock to be made or broken quickly without damage to either the dock or the ship. In view of the large size of the vessel typically used, the elements of a mooring robot must be structurally efficient in order to avoid the necessity of providing a large and heavy structure to withstand the significant forces which are encountered. It should also desirably have a low energy consumption.

Another desirable characteristic of a mooring robot, as discussed in WO 0162585, is the ability to absorb loads in the horizontal plane (i.e. external loads applied in the fore and aft direction and/or athwartships) to avoid the effects of impacts which could cause a loss of engagement. The ability to accurately control the position of a moored vessel is also an important requirement.

A disadvantage of the mooring robot and mooring system described in WO 0162585, however, is that fore and aft movement and vertical movement of the vessel relative to the mooring robot are accompanied by a component of movement athwartship, due to the telescoping arm of the robot being pivotably fixed. This feature makes accurately determining the position of the attachment elements complicated, and adds to the complexity of controlling the mooring robot. Also, since the plane of the vacuum cups is not maintained parallel to the surface of the hull with which it engages, additional wear of the vacuum seals may result as the cups are often pivoted as they first engage the hull. A further disadvantage of this, and like devices, is that the telescopic booms, being subject to significant bending loads, must be relatively massive and that, even with the arms retracted, the device requires significant space at the front mooring face of the dock.

WO 9114615 describes a mooring device that attempts to overcome some of the problems associated with the large bending moments exerted by longitudinal movement of the ship, parallel to the face of the dock. One of the solutions proposed is the incorporation of a spherical joint into a fastening mounted on the ship. Such a design however, requires the mooring device to be specially adapted, as well as a large degree of precision to align the two mechanical coupling components. Another solution is to take the longitudinal loads through stay lines, however the stays obstruct a significant area of the face of the dock.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a mooring robot for releasably fastening a moored vessel to a dock or to a second vessel, the mooring robot including:

an attractive attachment element releasably engagable with a surface for fastening the moored vessel;

a substantially vertical elongate guide to which the attachment element is slidably fixed, for raising and lowering the attachment element;

a substantially horizontal track to which the attractive attachment is sidably fixed, the horizontal track being aligned parallel with a longitudinal axis of the moored vessel for fore and aft movement of the attachment element;

a parallel arm linkage having two parallel arms each pivoted about respective axes which are parallel to the longitudinal axis of the moored vessel for extending and retracting the attachment element in a transverse direction, the parallel arms being pivotably fixed to the vertical guide; and respective powered actuating means for movement of the attachment element in the vertical, longitudinal and transverse directions.

Preferably the mooring robot is fixed to a mounting framework on the dock. The parallel arms are connected between the framework and the guide for moving the guide transversely and maintaining the guide vertical during the pivoting movement of the arms. The mooring robot further includes a carriage which engages with the vertical guide, and wherein the horizontal track is fixed to the carriage and slidingly receives a sub-frame to which the attachment element is fastened.

Preferably, the attractive element includes vacuum cups, each having circumferential elastomeric seals which define substantially planar face for engagement with a corresponding section of the freeboard of the moored vessel.

In a preferred embodiment the mooring robot is mounted to a fixed or floating dock. Alternatively, in the case where mooring robot is mounted on the moored vessel, the surface may be, for example, a plate fixed to a dock.

Preferably the actuating means of the parallel arm linkage is a linear actuator which is pivotably connected between the framework and the vertical guide. Double-acting hydraulic rams may provide the actuating means for both the parallel arm linkage in the transverse direction and the movement of the attachment element relative to the track in the longitudinal direction. Preferably an hydraulic accumulator is connected to both rams for providing a resilient action tending to restore them to a pre-defined operating position.

Preferably a hydraulic motor driving a loop of chain fixed to the carriage is employed for raising and lowering the carriage fixed to the guide, but it will be appreciated that other linear actuators may also be employed. Means are provided for both fixing the carriage with respect to the guide and also for allowing it to rise and fall substantially freely as required in operation.

Preferably a spherical joint permits a limited degree of pivoting movement of the attachment elements relative to the mooring robot. Optionally, a universal joint or a resilient element may be employed for providing this limited degree of pivoting movement.

According to another aspect of the present invention there is provided a mooring system comprising at least one mooring robot substantially as described above wherein the operation of each mooring robot is controlled by a remote controller.

According to another aspect of the present invention there is provided a method of operating a mooring system for driving the ship in a longitudinal direction to reposition it along the dock, including the steps:

a) providing a mooring system substantially as described above;

b) determining the desired distance and direction in which the ship is to be moved longitudinally;

c) for each mooring robot in turn, sequentially detaching the attachment element from the hull, moving the attachment element to its extent of longitudinal travel in a direction opposite to the desired direction and then reattaching the attachment element;

d) driving each attachment element in the desired direction; and e) repeating step c) and d) until the desired position is reached.

Preferably, the method includes the further step of sequentially moving each attachment element to a neutral position, as hereinbefore defined.

This invention provides a mooring robot which is effective in operational use, and compact making efficient use of the limited space available at the front mooring face of a dock. The device may be economically constructed and has an overall simple but structurally efficient design that minimizes manufacturing costs and maximizes performance. It allows for accurate positioning in three dimensions of the vacuum cups and maintains the vacuum cups generally parallel to the hull surface throughout its travel.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
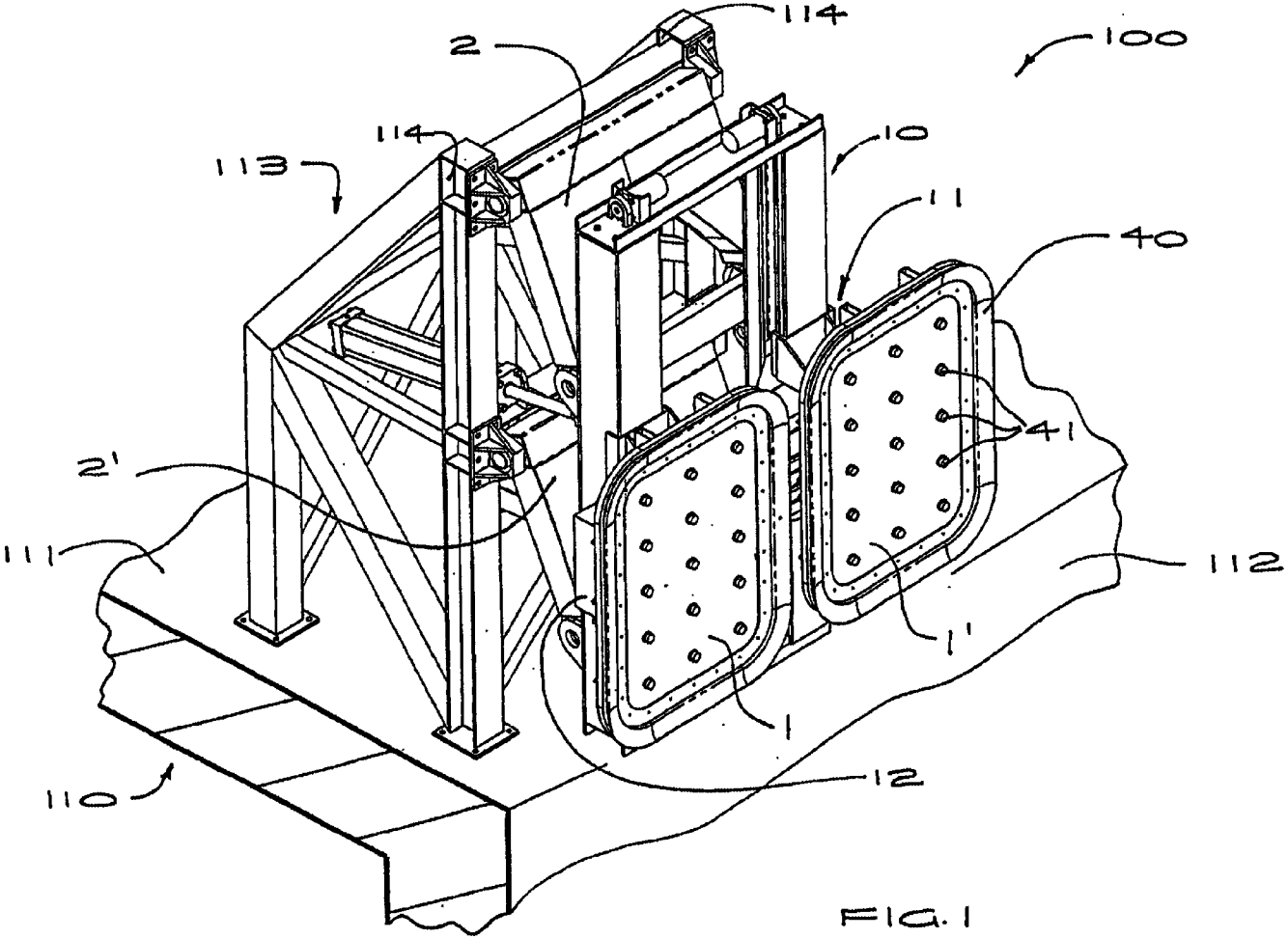
FIG. 1 is a pictorial view of a preferred embodiment of a mooring robot of the present invention.

Referring to FIG. 1, a preferred embodiment of the mooring robot 100 is mounted to a dock 110, fixed adjacent to a front mooring face 112 of the dock. The mooring robot 100 includes a pair of vacuum cups 1, 1' which are maintained substantially parallel to the plane of the front mooring face 112 for engagement with the hull of a vessel (not shown). The mooring robot 100 is capable of positioning the vacuum cups 1, 1' in three dimensions, referred to herein as "vertical", "longitudinal" and "transverse", wherein "longitudinal" refers to a direction perpendicular to the vertical axis and parallel to the longitudinal axis of the moored vessel or the front mooring face 112 of the dock.

The mooring robot 100 is fixed to a framework 113 fastened upon a generally horizontal surface 11 of the dock. In alternative embodiments (not shown) the mooring robot 100 may be mounted upon a suitable structure below the surface 111 to maintain the upper surface 11 clear of any obstructions. A parallel arm linkage provides for movement of the vacuum cups 1, 1' in the transverse direction, and includes parallel upper and lower arms 2, 2' connected between a pair of columns 114 of the framework 113 and a vertical guide 10. A carriage 11 engages with the vertical guide 10 to provide vertical movement. A sub-frame 12 to which the vacuum cups 1, 1' are mounted is slidably engaged with the carriage 11 for longitudinal movement of the vacuum cups 1, 1'.

Figures 2, 2A:
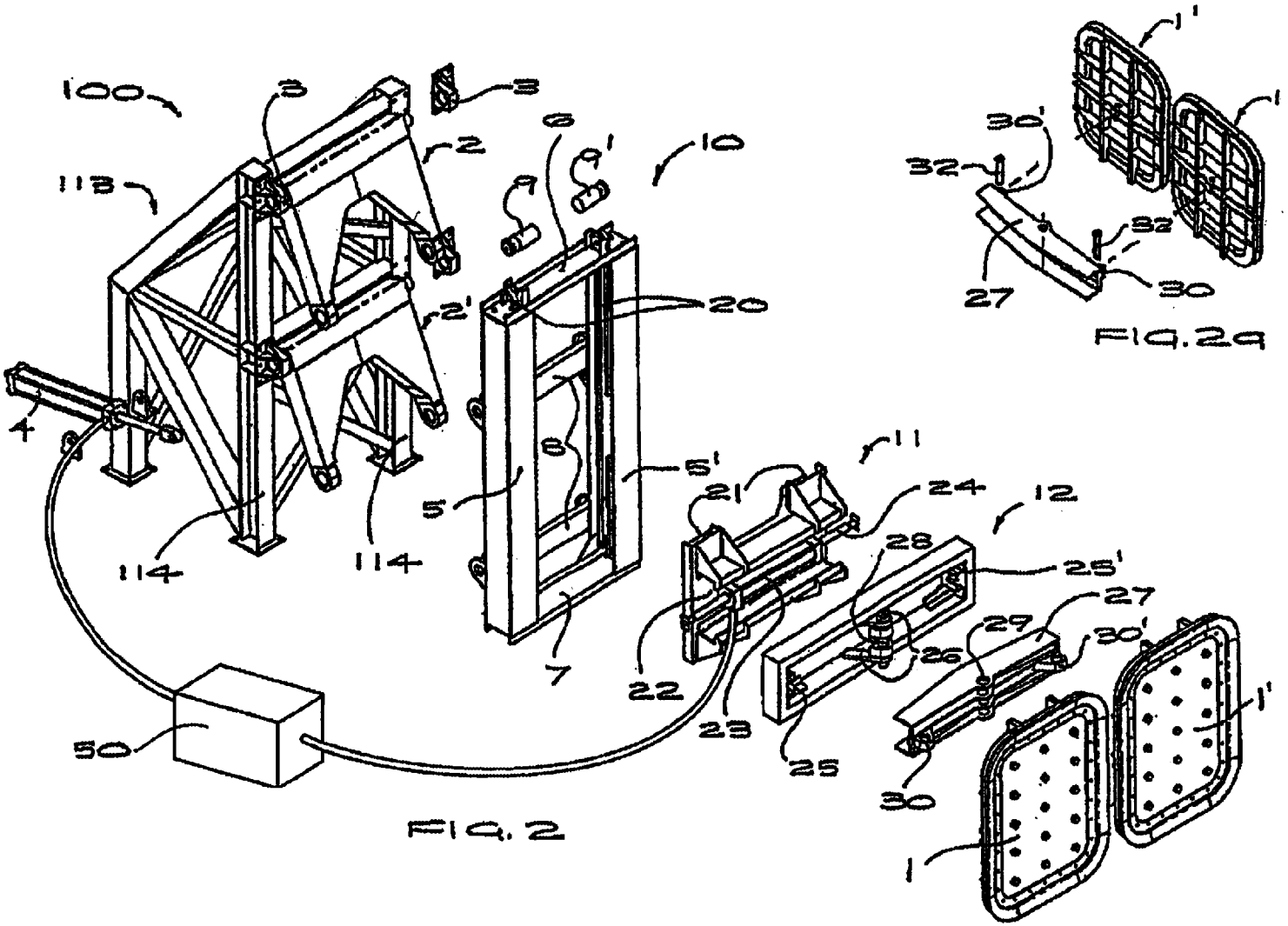
FIG. 2 is an exploded view of the mooring robot of FIG. 1.
FIG. 2*a* shows part of the mooring robot of FIG. 2 from a rotated viewpoint.

Referring to FIG. 2, each of the arms 2, 2' is fixed to the framework 113 for pivoting movement about respective longitudinally extending axes, each arm 2, 2' being fixed in bearings 3 fastened to the columns 114. Likewise, a pivoting connection is provided between the arms 2, 2' and the guide assembly 10. Power actuation of the transverse movement is provided by a hydraulic ram 4, which is also pivotably connected between the framework 113 and the guide assembly 10. It will be understood that the arms 2, 2' thus maintain the guide 10 vertical throughout the transverse movement.

The guide 10 is an assembly including a pair of parallel elongate guide members 5, 5' connected by cross members 6, 7 and 8. Fixed to the top cross member 6 are two hydraulic motors 9, 9' which are each connected to a loop of chain 20 which extends parallel to each of the guide members 5, 5' and is connected to the carriage 11 for power actuated raising and lowering thereof.

The carriage 11 includes vertical channels 21, 21' for engagement with the guide members 5, 5' and a longitudinally extending track 22 in which the sub-frame 12 is slidingly received. Longitudinal movement of the vacuum cups 1, 1' is power actuated by hydraulic ram 23 fixed in the track 22, the ram 23 being a double-acting type with a continuous piston rod 24 extending from both ends of the cylinder 23.

Slidingly received in the track 22, the rectangular sub-frame 12 has opposing fixtures 25, 25' to which opposite ends of the piston rod 24 are fixed. In a central part of the sub-frame 12, brackets 26 are secured for fixing the sub-frame 12 to a mounting beam 27 by means of a pin 28 for pivoting about a substantially vertical axis.

The beam 27 is an intermediate member connecting both the vacuum cups 1, 1' to the sub-frame 12 and includes a central aperture 29 for receiving the pin 28 and brackets 30, 30' at opposite ends thereof for connection to each of the vacuum cups 1, 1' respectively.

As illustrated in FIG. 2*a*, each bracket 30, 30' has a vertically extending aperture 31 in which a spherical bearing (not shown) is mounted for engagement a pin 32 to fix the vacuum cups 1, 1'. The spherical bearing permits a limited degree of angular rotation of the vacuum cups 1, 1' about two mutually perpendicular axes, and combined with pivoting about the axis of the pin 32 provides three degrees of freedom of rotational movement, thus allowing this connection to accommodate rotations resulting from roll, yaw and pitch of the ship when fastened by the mooring robot 100.

Each mooring robot 100 also includes a hydraulic power pack (not shown) mounted inside the framework 113 and associated controls (not shown). A vacuum pump (not shown) provides means for drawing a vacuum in the vacuum cups 1, 1'. Vacuum and hydraulic connections are by means of flexible hoses (not shown). For control of the robot, movement of the vacuum cups 1, 1' in each of the dimensions is measured by respective linear position sensors (not shown). This position information together with hydraulic pressures in the rams 4 and 23 and vacuum measured in each vacuum cup 1, 1' is monitored by a robot control computer (not shown) and transmitted as required to a remote controller (not shown) which, in the preferred embodiment controls a mooring system comprising at least two pairs of mooring robots 100.

Figure 3:
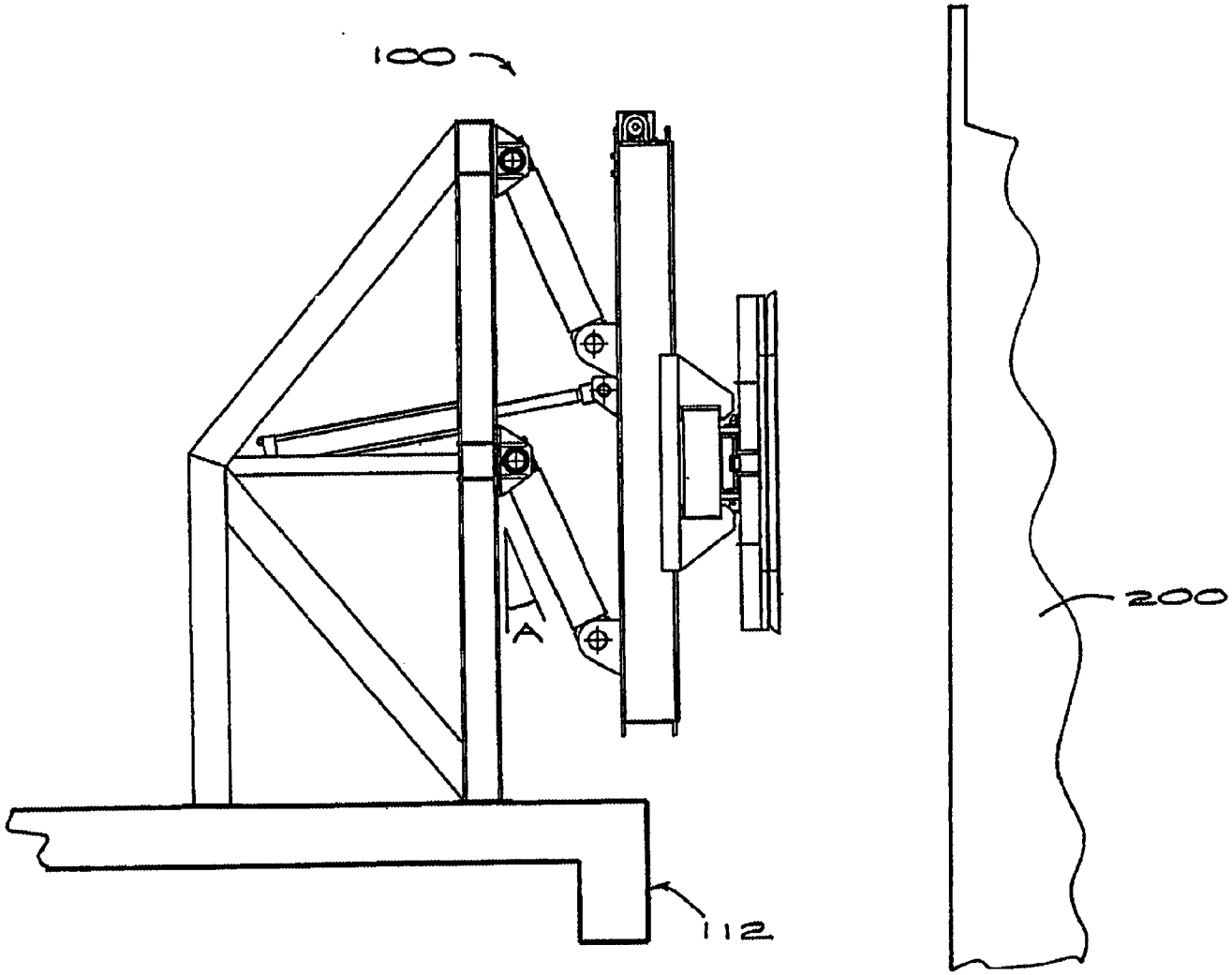
FIG. 3 is a side elevation of the mooring robot of FIG. 1.

Referring to FIG. 3, to make fast a ship, the vacuum cups 1, 1' are extended from the front mooring face 112 when a ship 200 approaches. The arms 2, 2' rotate between a retracted position (not shown) to the partially extended position (as shown in FIG. 3) through an angle A. The angle A being approximately 90 degrees at maximum horizontal travel. The mooring robot 100 extends the vacuum cups 1, 1,' out to engage a planar section of the hull. Each vacuum cup 1, 1' has a peripheral seal 40 and a plurality of abutments 41 (see FIG. 1) which prevent over deformation of the seal 40. The vacuum cups 1, 1' are able to rotate to conform to any curve of the hull. Most bulk, passenger and container ships in particular have sides that are substantially planar and parallel to the front face of the dock 112, except possibly near the bow and stern of the ship which are not used for mooring using the mooring robot 100. Sensors (not shown) indicate engagement with the hull. The vacuum cups 1, 1' are then evacuated to fasten to the ship in the known manner, before actuating the mooring robot 100 to move the ship to the desired moored position. When the desired moored position is reached the vacuum pump may be stopped, with a vacuum accumulator (not shown) in the line to the vacuum cups 1, 1' maintaining the vacuum.

Optionally, the method of mooring the ship includes a first step of initially selecting the height of the vacuum cups 1, 1' depending on the state of the tide and state of loading of the ship. In this way the vertical travel required to be accommodated may be reduced. In the moored position, each mooring robot 100 is in a 'neutral' position, an intermediate position near the centre of its longitudinal and transverse travel. Preferably, in the neutral position the robots are at varying heights, such that they do not all simultaneously reach the limits of their vertical travel.

Each mooring robot 100 maintains the ship, within certain limits, in the moored position in response to changing conditions of wind, tide, swell and displacement. On attaining the desired moored position the hydraulic pump (not shown) is stopped and an accumulator 50 is cut into the lines to the rams 4 and 24, thus providing a resilient action. When displaced from the predefined moored position longitudinally or transversely by external forces the accumulator is pressurized and provides hydraulic pressure to the rams 4, 23 tending to restore the ship to the moored position. The hydraulic motors 9, 9' (or linear actuators, if used) for raising and lowering the vacuum cups 1, 1' are switched into a free-floating mode allowing the carriage 11 (and thus the ship 200) to rise and fall with the tide, state of loading, etc.

Figure 4:
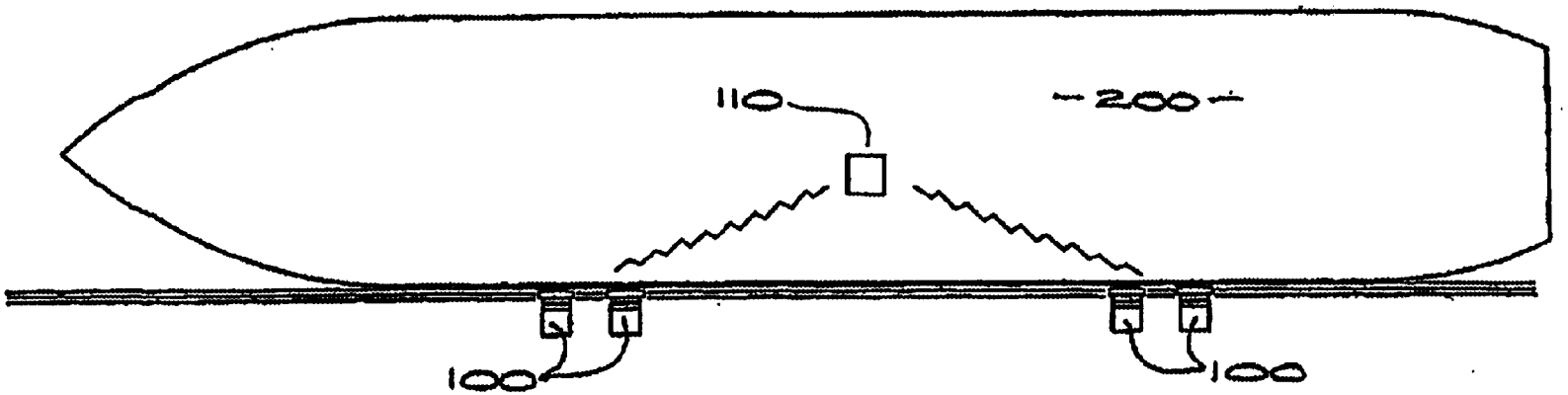
FIG. 4 is a plan view illustrating the deployment of mooring robots of the present invention.

As shown in FIG. 4, a mooring system in the illustrated embodiment includes two pairs of mooring robots 100, which are installed between energy-absorbing fenders placed at intervals along the front face of the dock 12. Providing the mooring robots 100 in pairs, each having an independent hydraulic and vacuum supply provides a level of redundancy for safety. Each of the mooring robots 100 is connected by a wireless link to a remote control unit 110 mounted aboard the ship 200. The remote control transmits a signal to each mooring robot 100 to control its position and operation, and receives feedback of actual position and operating conditions. Positional feedback indications from each mooring robot 100 can be provided to other systems, for example, automatic loading systems which require information on the position of the ship.

Under most conditions the operation of the mooring robots 100 is coordinated, for example, when mooring and unmooring the ship, or when performing vertical or horizontal stepping movements, as described in WO 0162584. In severe conditions, monitoring of hydraulic pressures and vacuum in the vacuum cups 1, 1' allows the performance of the system to adjusted accordingly, for example, by running the vacuum pump continuously to maintain a higher vacuum when required.

Under normal conditions when the mooring robot 100 approaches the extent of its vertical travel the system initiates a stepping sequence moving each mooring robot 100 alternately in a stepwise manner, however in a highly loaded state, stepping may be prevented to ensure security of the vessel, with the system indicating an alarm condition. A warning is also indicated when the system is approaching its holding capacity, allowing the ship's captain to take emergency action.

Movement of the mooring robots 100 may also be coordinated for driving the ship fore and aft to reposition it along the dock, as required. For example, to drive the ship forward, the vacuum cups 1, 1' of each mooring robot 100 are sequentially detached from the hull, moved to their extent of aft travel and then reattached. With all the vacuum cups 1, 1' at their aft extent, they are all driven together to their forward extent. To move the ship further than the limit of horizontal travel, this process may be repeated in a stepwise manner. Once this longitudinal movement is completed, each mooring robot 100 is returned to a neutral position.

Aspects of the present invention have been described by way of example only and it should be appreciated that modifications and additions may be made thereto without departing from the scope thereof.

What is claimed is:

1. A mooring robot for releasably fastening a moored vessel to a dock or to a second vessel, the mooring robot including:

an attractive attachment element releasably engageable with a surface for fastening the moored vessel;

a substantially vertical elongate guide to which the attachment element is slidably fixed, for raising and lowering the attachment element;

a substantially horizontal track to which the attractive attachment is slidably fixed, the horizontal track being aligned parallel with a longitudinal axis of the moored vessel for fore and aft movement of the attachment element;

a parallel arm linkage having two parallel arms each pivoted about respective axes which are parallel to the longitudinal axis of the moored vessel for extending and retracting the attachment element in a transverse direction, the parallel arms being pivotably fixed to the vertical guide; and respective powered actuating means for movement of the attachment element in the vertical, longitudinal and transverse directions.

2. The mooring robot of claim 1 further comprising a mounting framework fixed to the dock, wherein the parallel arms are connected between the framework and the guide for moving the guide transversely and maintaining the guide vertical during the pivoting movement of the arms; the mooring robot further including a carriage which engages with the vertical guide, and wherein the horizontal track is fixed to the carriage and slidingly receives a sub-frame to which the attachment element is fastened.

3. The mooring robot of claim 2 wherein the actuating means of the parallel arm linkage comprises a linear actuator pivotably connected between the framework and the vertical guide.

4. The mooring robot of claim 2 further including means for both fixing the carriage with respect to the guide and also for allowing it to rise and fall substantially freely as required in operation.

5. The mooring robot of claim 1 wherein said surface is substantially planar and at least part of the attachment element defines a corresponding substantially planar face, the parallel arm linkage maintaining the planar face substantially parallel with the surface throughout the transverse movement of the attachment element.

6. The mooring robot of claim 1 wherein the mooring robot is mounted to a fixed or floating dock.

7. The mooring robot of claim 1 wherein the attractive element comprises one or more vacuum cups, and said surface is a section of a freeboard of the moored vessel.

8. The mooring robot of claim 1 wherein double-acting hydraulic rams provide the actuating means for both the parallel arm linkage in the transverse direction and the movement of the attachment element relative to the track in the longitudinal direction.

9. The mooring robot of claim 8 wherein a hydraulic accumulator is connected to both rams for providing a resilient action tending to restore them to a pre-defined operating position.

10. A mooring system comprising one or more mooring robots as claimed in claim 1 and at least one remote controller wherein the operation of each mooring robot is controlled by at least one of the remote controllers.

11. The mooring system as claimed in claim 10 wherein four mooring robots are mounted to a dock in two pairs.

12. A method of operating a mooring system for driving a ship in a longitudinal direction to reposition it along the dock, including the steps:

a) providing a mooring system including;

i. at least four mooring robots for releasably fastening a moored vessel to a dock or to a second vessel, each mooring robot including:

an attractive attachment element releasably engageable with a surface for fastening the moored vessel;

a substantially vertical elongate guide to which the attachment element is slidably fixed, for raising and lowering the attachment element;

a substantially horizontal track to which the attractive attachment is slidably fixed, the horizontal track being aligned parallel with a longitudinal axis of the moored vessel for fore and aft movement of the attachment element;

a parallel arm linkage having two parallel arms each pivoted about respective axes which are parallel to the longitudinal axis of the moored vessel for extending and retracting the attachment element in a transverse direction, the parallel arms being pivotably fixed to the vertical guide; and respective powered actuating means for movement of the attachment element in the vertical, longitudinal and transverse directions; and ii. at least one remote controller wherein the operation of each mooring robot is controlled by at least one of the remote controllers wherein four mooring robots are mounted to a dock in two pairs;

b) determining a desired distance and direction in which the ship is to be moved longitudinally;

c) for each mooring robot in turn, sequentially detaching the attachment element from the hull, moving the attachment element to its extent of longitudinal travel in a direction opposite to the desired direction and then reattaching the attachment element;

d) driving each attachment element in the desired direction; and e) repeating step c) and d) until the desired position is reached.

13. The method of operating a mooring system as claimed in claim 12 further including the step:

f) sequentially moving each attachment element to a neutral position.

* * * * *